US006694565B2

(12) United States Patent
Medeiros

(10) Patent No.: US 6,694,565 B2
(45) Date of Patent: Feb. 24, 2004

(54) CLEANING APPARATUS FOR CHENILLE PRODUCTION MACHINE

(75) Inventor: Ricardo Medeiros, Swansea, MA (US)

(73) Assignee: Quaker Fabric Corporation of Fall River, Inc., Fall River, MA (US)

( * ) Notice: Subject to any disclaimer, the term of this patent is extended or adjusted under 35 U.S.C. 154(b) by 281 days.

(21) Appl. No.: 09/971,487

(22) Filed: Oct. 5, 2001

(65) Prior Publication Data

US 2003/0066155 A1 Apr. 10, 2003

(51) Int. Cl.[7] ..... D04B 35/32
(52) U.S. Cl. ..... 15/301; 15/309.1; 57/24
(58) Field of Search ..... 15/301, 303, 306, 15/309.1; 57/24, 203, 304

(56) References Cited

U.S. PATENT DOCUMENTS

| | | | | | |
|---|---|---|---|---|---|
| RE20,917 | E | | 11/1938 | Eaddy | |
| 2,717,484 | A | * | 9/1955 | Hofstetter | 57/305 |
| 3,018,503 | A | * | 1/1962 | Hijiya et al. | 15/312.1 |
| 3,378,998 | A | * | 4/1968 | Shackelford | 15/301 |
| 3,459,010 | A | * | 8/1969 | Ferri | 66/168 |
| 3,777,329 | A | * | 12/1973 | Lane | 15/301 |
| 3,839,764 | A | * | 10/1974 | Clayton | 15/301 |
| 3,869,850 | A | | 3/1975 | Gross | |
| 4,107,911 | A | * | 8/1978 | Yamana et al. | 57/304 |
| 4,109,451 | A | * | 8/1978 | Yamada et al. | 57/302 |
| 4,947,509 | A | * | 8/1990 | Dinkelmann | 15/301 |
| 5,154,045 | A | * | 10/1992 | Saruwatari et al. | 57/304 |
| 5,177,985 | A | * | 1/1993 | Igarashi et al. | 66/168 |
| 5,323,509 | A | * | 6/1994 | Igarashi et al. | 15/301 |
| 5,333,354 | A | * | 8/1994 | Takemoto et al. | 15/301 |

* cited by examiner

*Primary Examiner*—Terrence R. Till
(74) *Attorney, Agent, or Firm*—Gottlieb, Rackman & Reisman, P.C.

(57) ABSTRACT

A cleaning apparatus for a chenille production machine has a yarn fabricating head enclosure that includes a base member positioned in parallel and in close proximity with a back side of the yarn fabricating head and fixedly mounted to the supporting frame, a body member circumferentially encompassing the yarn fabricating head and fixed to the base member, and a cover member secured to the body member to enclose the fabricating head for collecting the fabricating dust. The cover member has at least one opening port for direct removal of the dust. A dust evacuating system is associated with the opening port. The dust evacuating system has a guiding member that is positioned within the cover member to direct the dust from the enclosure to a hose connected to an exhaust system. The cleaning apparatus optionally includes an automatic purge system which provides an automated cleaning service of the yarn fabricating head in a predetermined time intervals and for a predetermined duration.

16 Claims, 8 Drawing Sheets

CLEANING APPARATUS FOR CHENILLE PRODUCTION MACHINE

BACKGROUND OF THE INVENTION

1. Field of the Invention

This invention relates to textile fabrication machines. More particularly, to chenille production machines and especially to apparatus that allow the collection and evacuation of fabric dust from chenille production machines.

2. Description of Related Art

Chenille yarn producing machines of known design, such as those manufactured by Giesse, S.r.l., Via Baldanzese, 247, Calenzano, Italy, or as shown in U.S. Pat. No. 6,119,444 (Sostegni) are well known in the art. In general, they comprise a yarn-forming head with a gauge on which fuzzy threads are to be cut into predetermined lengths by a circular blade. A pair of rollers are disposed at a short preset distance from the gauge to twist two separate interweaving threads. The interweaving threads, as they are twisted, engage the lengths of fuzzy thread between themselves to form chenille yarn.

The major deficiency of such a machine is that as the fuzzy threads are cut and, further, as the interweaving threads and the fuzzy threads are combined to form the chenille yarn, a large quantity of fabric dust is generated and broadcast into the air surrounding the yarn producing head. This dust then penetrates and accumulates in the mechanism of the head thus increasing wear and causing the cutting disks to become misaligned. Additionally, any fabric dust allowed into the work area surrounding the chenille yarn producing machine impacts upon the working conditions of the operators of the machine.

U.S. Pat. No. 3,869,850 (Gross) illustrates a vacuum air cleaning system for chenille production machines. The air cleaning system has an intake directly under the cutting blades and near the finished yarn bobbins to remove lint and dust from the machines.

U.S. Pat. No. RE20,917 (Eaddy) describes an apparatus for cleaning textile machinery by inducing an air draft through the normal opening of the textile machinery. The apparatus has a system of hoppers, ducts and baffles connected to a fan to collect the lint, dust, and fly from the textile machine.

SUMMARY OF THE INVENTION

It is a primary objective of the present invention to provide a cleaning apparatus for a chenille production machine that will allow complete removal of the fabric dust from the production area.

It is another objective of the proposed invention to provide a cleaning device that establishes a clean environmental condition of the working space.

It is a further objective of the present invention to provide a cleaning device for a chenille-producing machine that is simple to manufacture and easy to use.

To attain the above-mentioned objectives, the presented invention is constructed in the following manner.

A cleaning apparatus is provided for a chenille production machine that includes a yarn fabricating head, the head having cutting elements and positioned on a supporting frame. The cleaning apparatus has an yarn fabricating head enclosure that comprises a base member positioned in parallel and in close proximity with a back side of the yarn fabricating head and is fixedly mounted to the supporting frame; a body member circumferentially encompassing the yarn head and fixed to the base member; and a cover member secured to the body member to enclose the fabricating head for collecting the fabricating dust. The cover member has at least one opening port for direct removal of the dust. There is a dust evacuating system associated with said at least one opening port. The dust evacuating system includes a guiding member internally positioned within the cover member, the guiding member having a first end disposed in proximity to the yarn fabricating head and a second end affixed to the opening port. The opening port being coupled to a means for evacuating dust from said cleaning apparatus. The guiding member is further provided with a longitudinal slot located on a bottom thereof, the slot being dimensioned so as to prevent contact of the guiding member with the cutting element of the yarn fabricating head.

The cleaning apparatus optionally includes an automatic purge system, said system being activated in one or more predetermined time intervals and for one or more predetermined durations. The automatic purge system includes a purge port situated on a front of said cover member and below said opening port with said purge port being coupled to an air tubing for introduction of compressed air into a cleaning apparatus.

The foregoing objectives and other objectives as well as the particular construction of the cleaning apparatus for chenille production machine will become more apparent and understandable from the following detailed description when read in connection with the accompanying drawings.

BRIEF DESCRIPTION OF THE ACCOMPANYING DRAWINGS

DETAILED DESCRIPTION OF THE INVENTION

Figure 1:
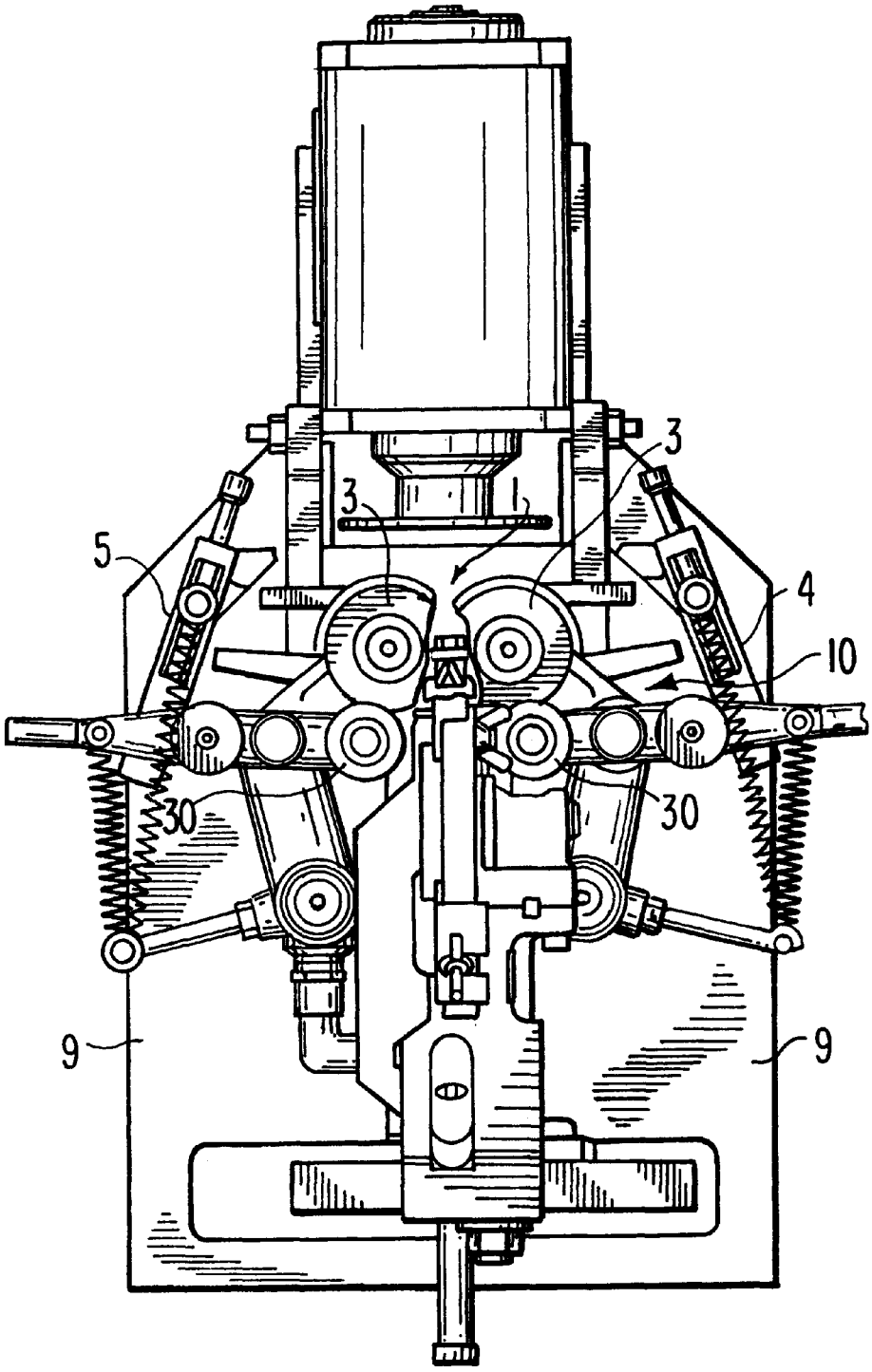
FIG. 1 is a front view of the chenille production machine with the cleaning apparatus absent.
Figure 2:
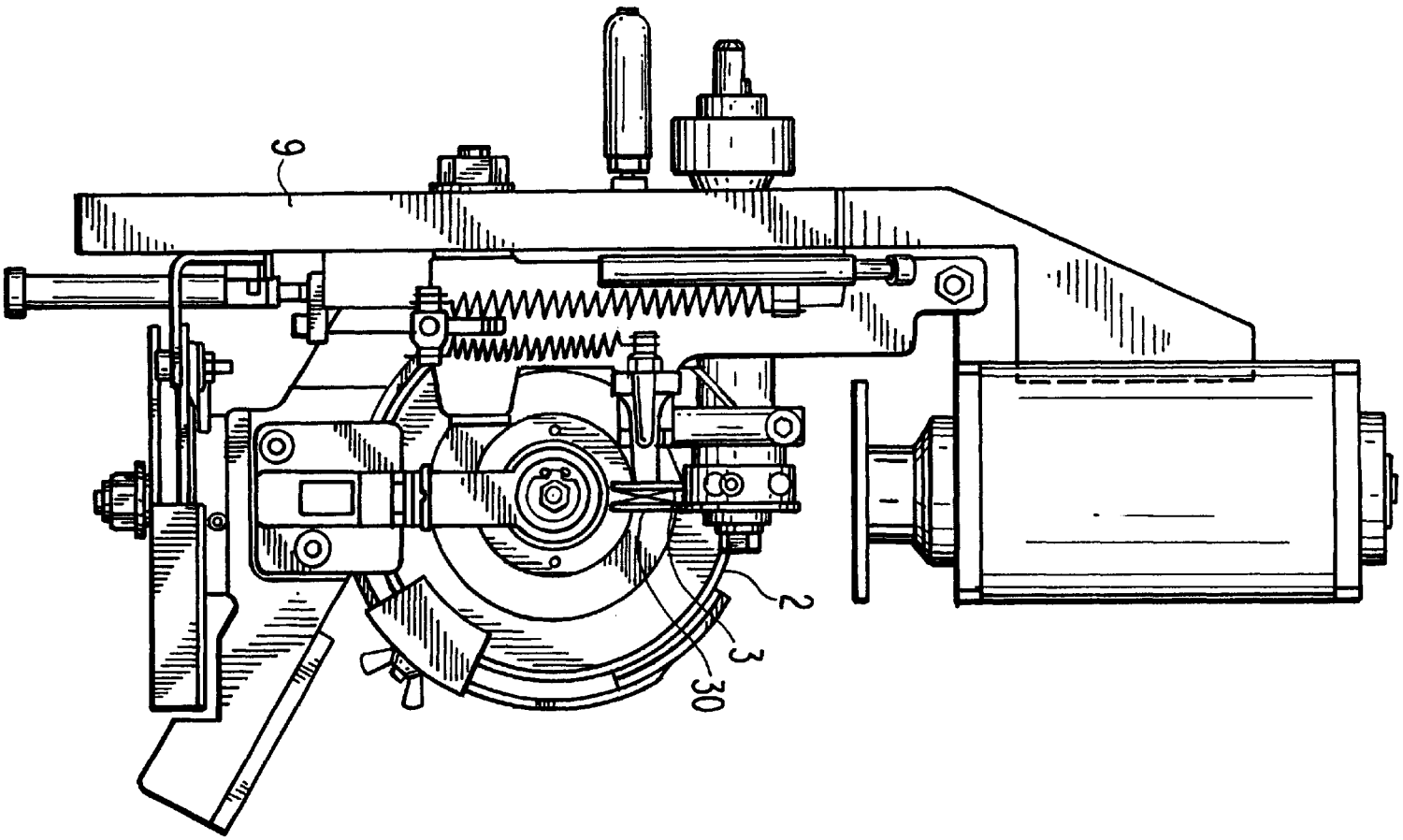
FIG. 2 is a side elevation view of the chenille production machine with the cleaning apparatus absent.

FIGS. 1 and 2 show a yarn fabricating head 10 of a conventional chenille production machine that includes a gauge 1 on which fuzzy threads are to be cut into predetermined lengths by a circular blade 2. The circular blade 2 is located in front of the gauge 1. A pair of rollers 3 and 30 are disposed at a short preset distance from the gauge 1 to twist two separate interweaving threads. The interweaving threads, as they are twisted, engage the lengths of fuzzy thread. The axis of rotation of the rollers 3 and 30 are parallel to each other and to the axis of rotation of the blade 2 so that the fuzzy threads are appropriately sized. The upper roller 3 has radial grooves 31. The springs 4 and 5 urge the rollers toward the gauge 1. Thereat, the rotating motion of the roller 3 against the gauge 1 pulls the lengths of the fuzzy threads therefrom into the rollers 3 and 30. The chenille fabricating head is fixed to the support frame 9 of a chenille yarn producing machine.

The yarn producing machine includes drive motors, and control circuits that supervise and control the functions of the yarn fabricating head and associated elements, such as thread delivery spindles, winding spindles, etc . . .

As the fuzzy threads are cut and the interweaving threads and the fuzzy threads are combined to form the chenille yarn, a large quantity of fabric dust is generated and broadcast into the air surrounding the yarn producing head.

Figure 3:
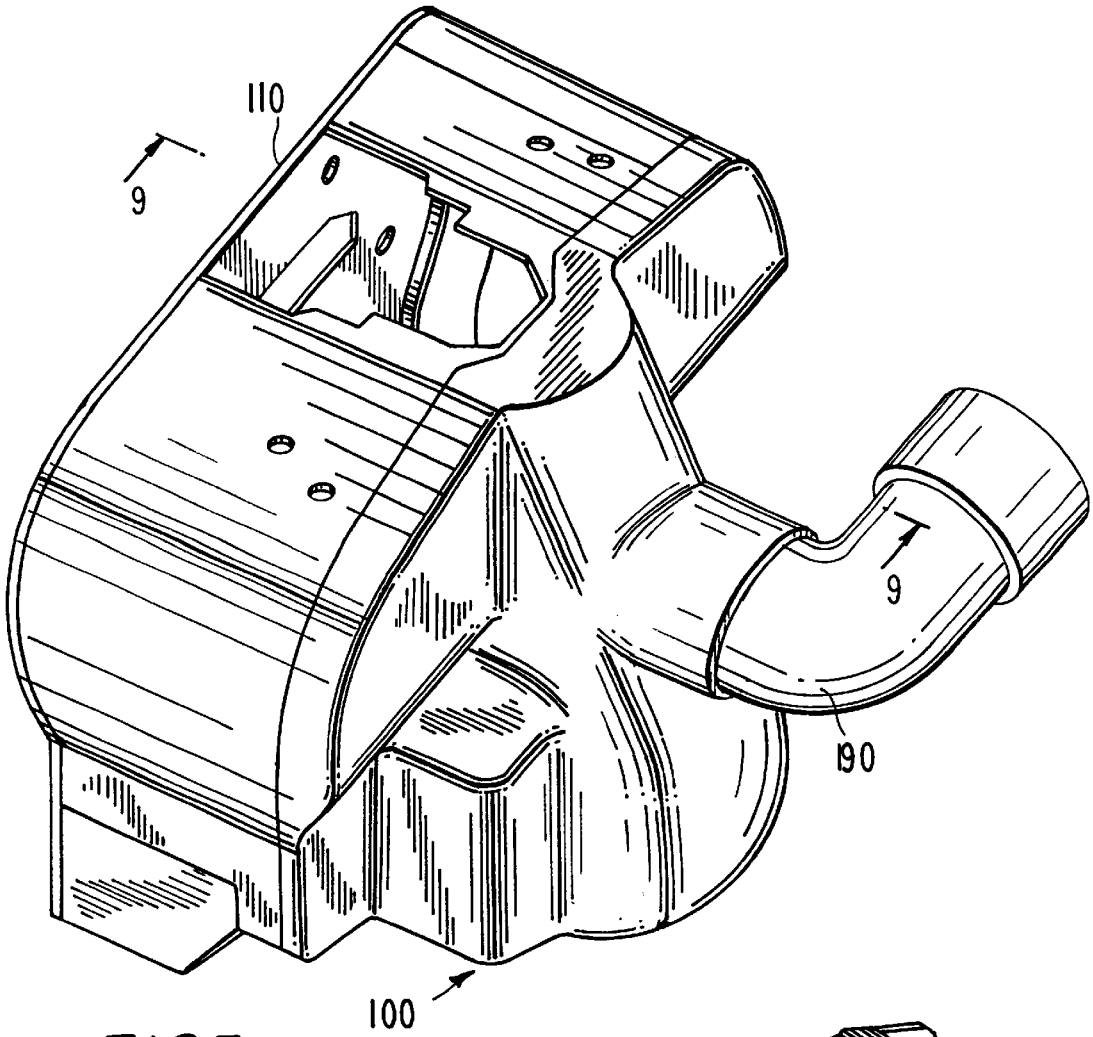
FIG. 3 is a prospective view of the cleaning apparatus according to the present invention.

An apparatus for removal the dust, generally designated as 100, is associated with the exhaust system that evacuates dust produced during the yarn fabrication process. The apparatus, as shown on FIG. 3, includes an enclosure 101, a base member in a form of a backplate 110, which is made from 16 ga galvanized steel, as seen on FIG. 5. The backplate is mounted to the framework (not shown) of the chenille production machine. At least two air-inlets 120 are provided on the backplate 110 for continuous introduction of the air into the inner area of the apparatus for maintaining the atmosphere pressure sufficient for functioning of the exhaust system.

Figure 6:
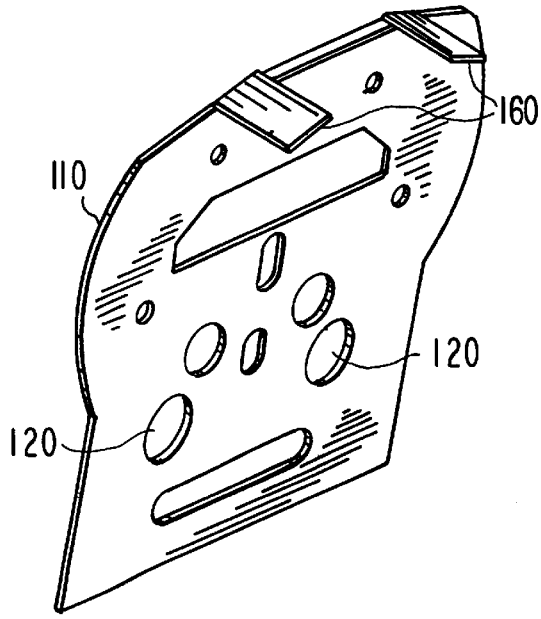
FIG. 6 is a perspective view of the base member of the enclosure of the cleaning apparatus according to the present invention.
Figure 5:
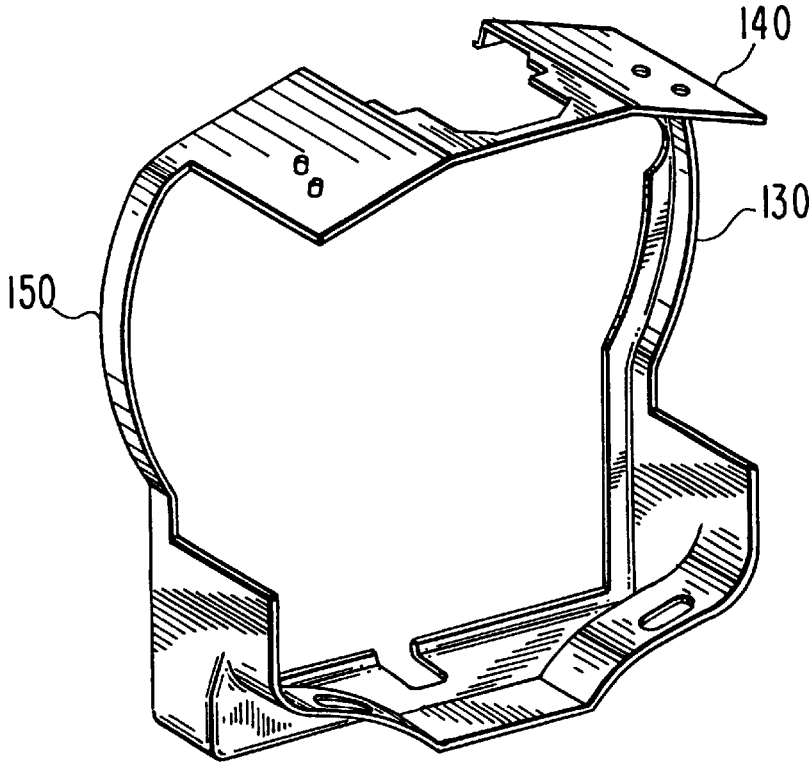
FIG. 5 is a perspective view of the body member of the enclosure of the cleaning apparatus according to the present invention.
Figure 7:
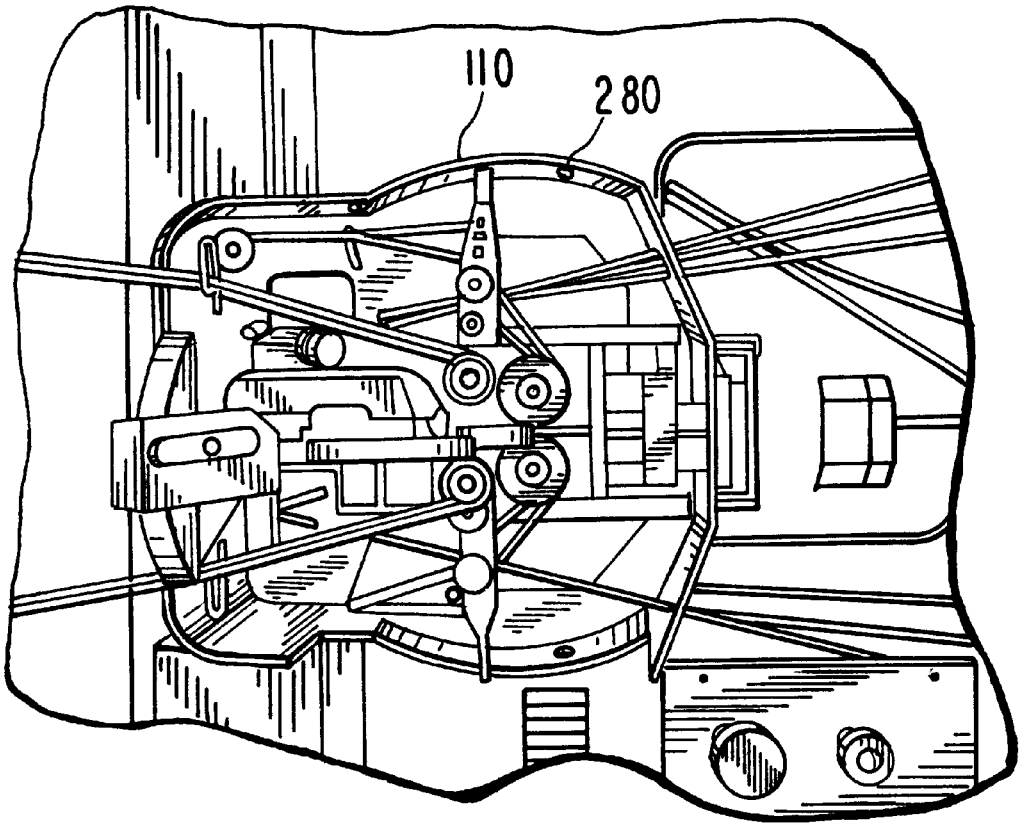
FIG. 7 is a front view of the chenille production machine with the base member of the enclosure of the cleaning apparatus showing elements for affixing the body member to the base member according to the present invention.

Turning to FIGS. 5 and 6, a body 130, formed of a black plastic, is designed to circumferentially encompass the yarn production head and be attached to the backplate 110 by means of threaded bolts as shown on FIG. 7. The body 130 has a top portion 140 protruding therefrom and in a plane perpendicular to the main portion 150. The top portion 140 is secured to two tabs 160 attached to the top of the backplate 110 to fixedly align the body 130 to the latter.

Figure 4:
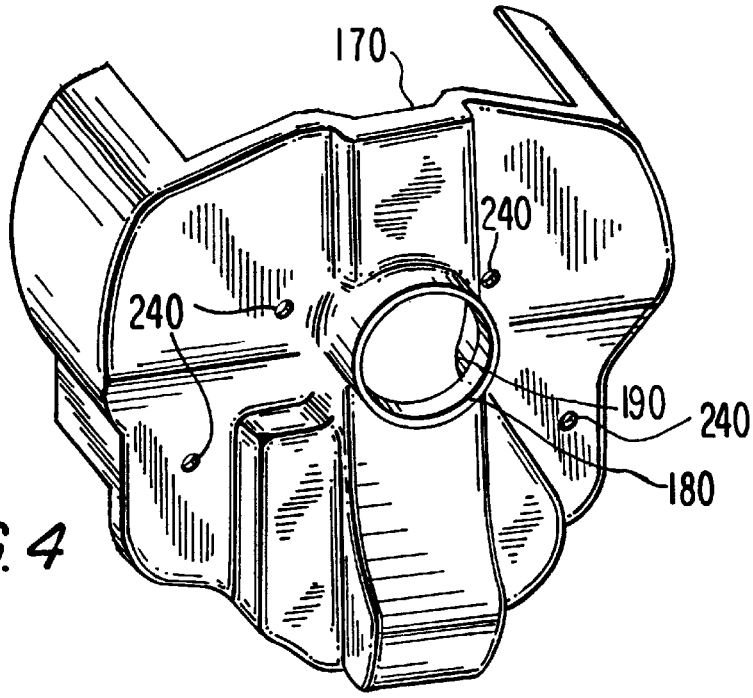
FIG. 4 is a perspective view of the cover member of the enclosure of the cleaning apparatus according to the present invention.

A body 130 is covered by a cover member 170, shown on FIG. 4, that is designed to have a shape complementary to the body 130 for complete enshrouding of a yarn fabricating head 10. An opening port 180 connected to the exhaust system is provided on the front of the cover member 170 for discharging dust from the cleaning apparatus. Also, cover member 170 includes a plurality of 5/16 inch purge ports 240 that allows manually introducing air into the enclosure 100. The cover member 170 is, preferably, made from a clear plastic of a preselected thickness.

Figure 9:
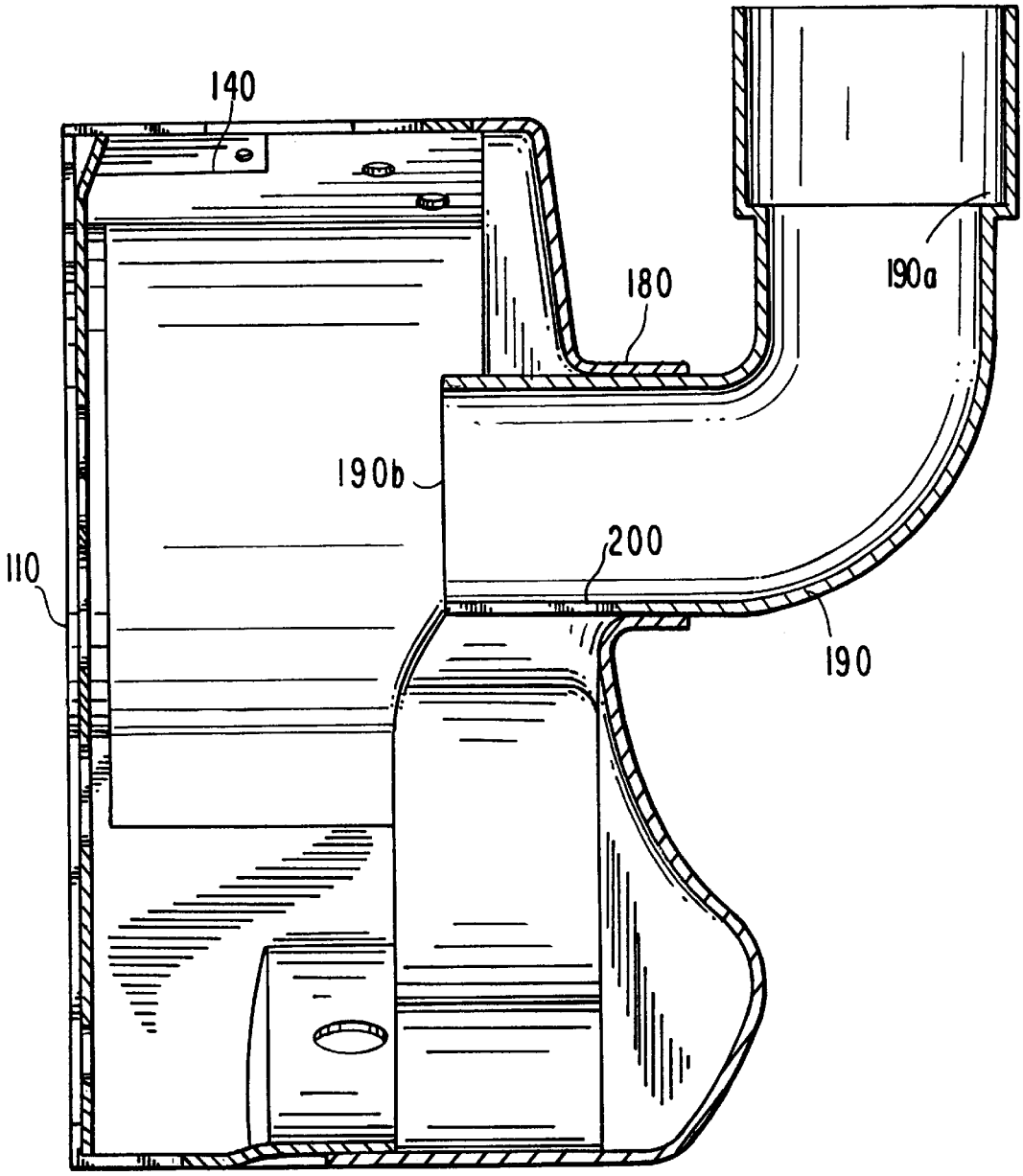
FIG. 9 is a sectional view taken along the line 9—9 on FIG. 3 of the enclosure of the cleaning apparatus showing the guiding member according to the present invention.

A cleaning apparatus further includes a 90° clear plastic elbow 190 that serves as a guiding channel through which the dust is transferred to the opening port 180 and then removed by the exhaust system. In reference to FIG. 9, the elbow 190 is fitted with its one end 190*a* within the opening port 180 and fixed thereto. The other end 190*b* of the elbow is positioned at a short distance from the gauge 1, rollers 3 and 30 and cutting blade 2 for capturing and freeing dust therefrom. To avoid an interference of the end 190*b* of the elbow 190 with the above-mentioned elements of the yarn fabricating head, especially with the cutting blade 2, a longitudinal slot 200 is formed on the bottom of the elbow. The elbow is sized to have a diameter that is substantially equal to the inner diameter of the opening port 180.

Figure 8:
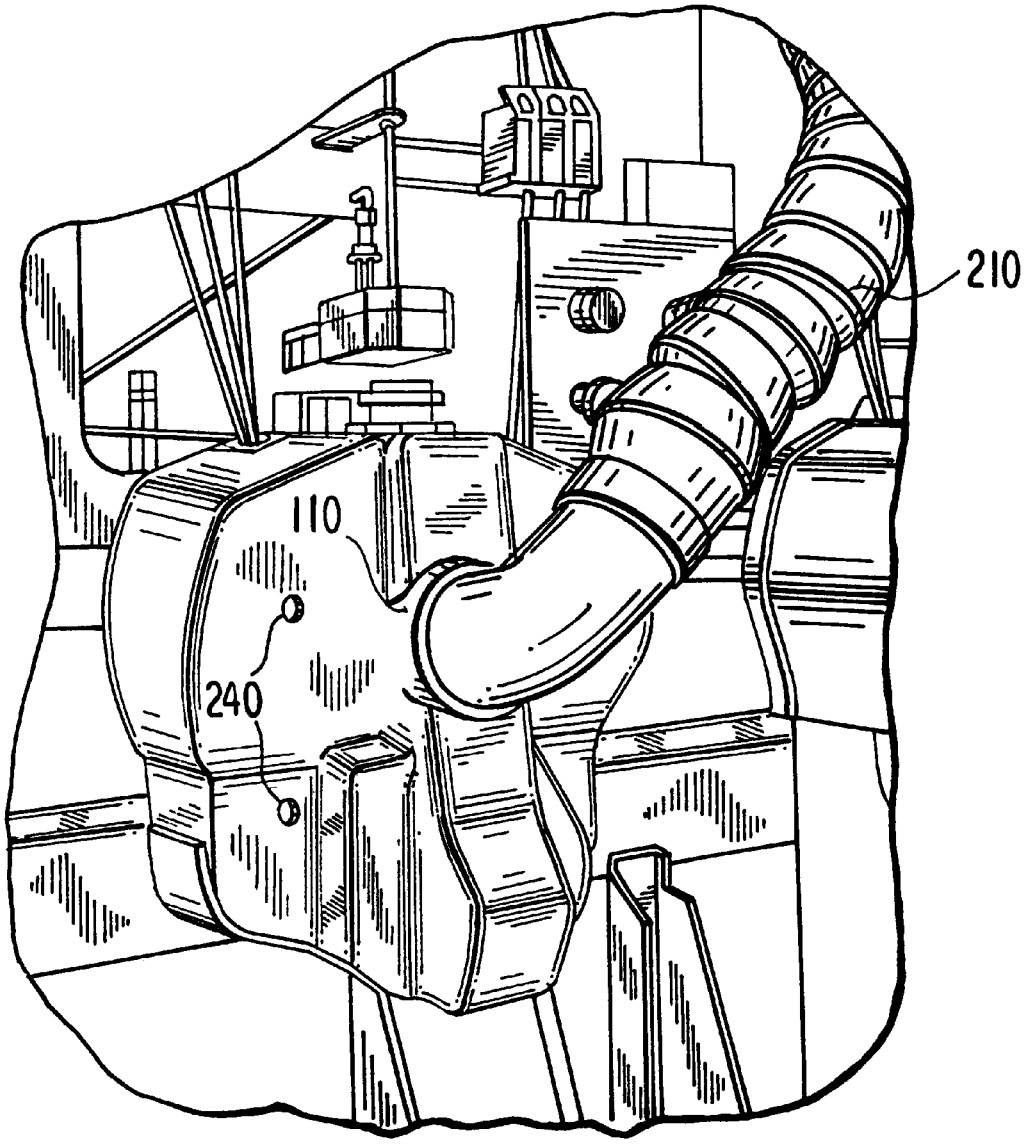
FIG. 8 is a front view of the chenille production machine with a cleaning apparatus connected to the exhaust system for evacuating dust according to the present invention.

An elbow end 190*a* is connected to a blue knuckle hose (LOC-LINE) 210, as shown in FIG. 8, which is, in turn, connected to the main manifold of the exhaust system through the balancing ball valve (not shown). The dust collected in the cleaning apparatus is thus continuously evacuated from the working area. Further, the hose 210 allows maintaining the cover member 170 in a position in respect to the body 130 when it is detached for the servicing of the head 10. The hose has a diameter of a size that is substantially equal to the outer diameter of the opening port 180.

In operation, compressed air is periodically introduced by the operator through purge ports 240 located on the front of the cover member 170 to remove dust caught on the working elements of the yarn fabricating head 10. The dust is then directed by the elbow 190 to the opening port 180 and discharged through the hose 210 by means of exhaust air.

Figure 10:
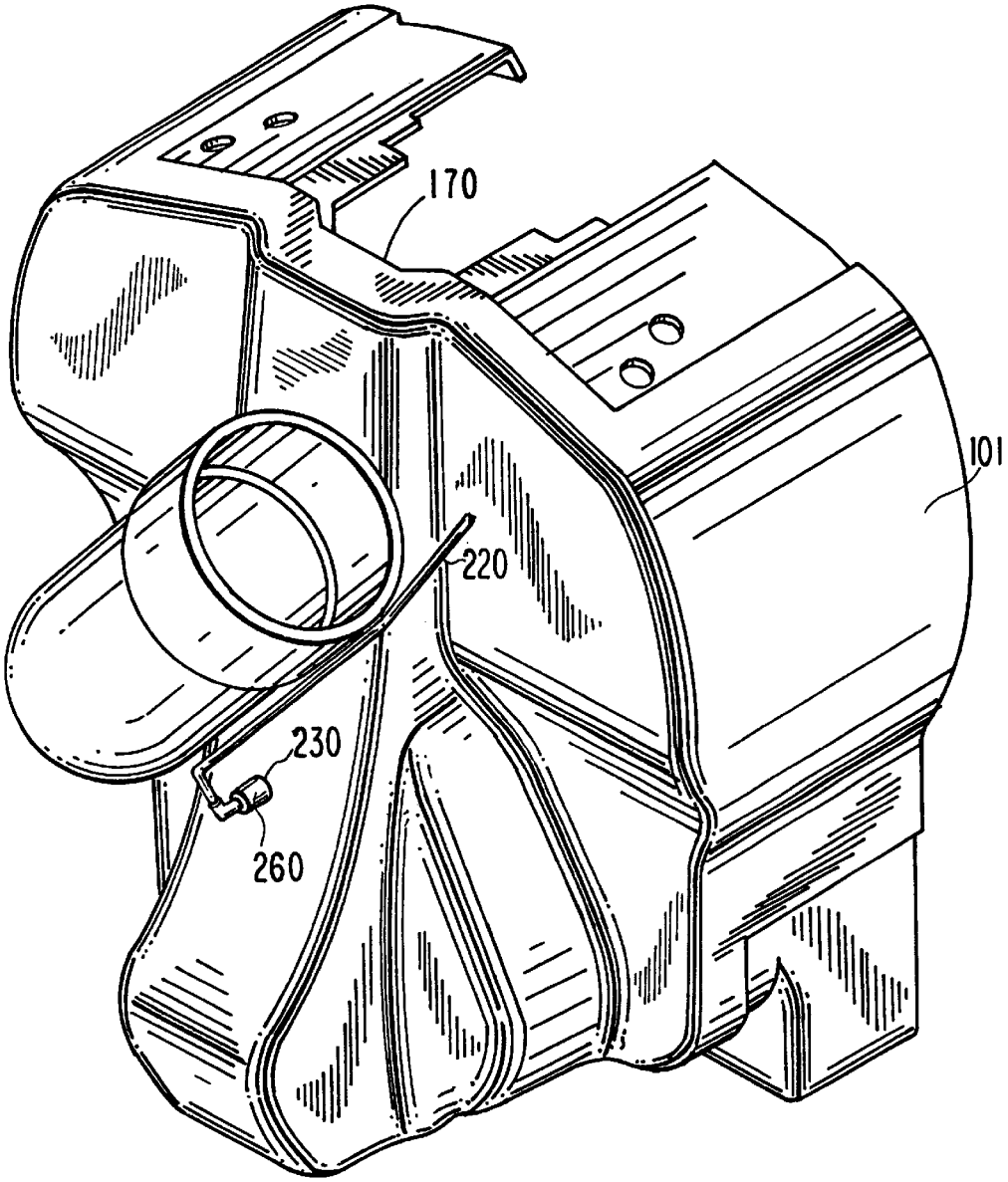
FIG. 10 is a prospective view of the cleaning apparatus showing elements of the automatic purge system according to the present invention.

FIG. 10 shows another embodiment of the present invention in which the cleaning apparatus includes an automatic purge system. To effect cleaning of the dust by this automatic system, the compressed air (60–80 psi) is introduced into the enclosure 100 through an 1/8 inch air tubing 220 and, consequently, a purge port 230 situated on the front of the cover member 170 and below the opening port 180. The air tubing 220 is connected to the purge port 230 by a 120 deg full cone spray nozzle 260. The tubing 220 is associated with a distribution header (not shown) disposed on the top of the chenille production machine. During operation, the process is monitored by a timer that allows the introduction of the air into the enclosure 101 in 20 minutes intervals and for a duration of 2 seconds. As in the previous embodiment the dust removed from the elements of the machine is discharged by the exhaust system.

The foregoing description of the present invention demonstrates the ability of the proposed cleaning apparatus that could be successfully employed for complete removal of the dust produced during the fabricating of the yarn in the chenille production machine or the like. Although this invention has been shown and described with reference to preferred embodiments thereof, it will be appreciated by those skilled in the art that various changes in form and details may be made without departing from the spirit and scope of the invention as define in the following claims.

What is claimed:

1. A cleaning apparatus for a chenille-production machine that includes a yarn fabricating head, said head having a gauge with cutting elements and being positioned on a supporting frame, the cleaning apparatus comprising:

an enclosure enshrouding the yarn fabricating head, said enclosure including:

a base member positioned in parallel and in close proximity to a back side of said yarn fabricating head and fixedly mounted to the supporting frame;

a body member circumferentially encompassing the yarn head and fixed to the base member;

a cover member secured to the body member, said body member and said cover member being shaped to complement each other, said cover member having at least one opening port for direct removal of dust produced during the manufacturing process; and a dust evacuating system interconnected with said at least one opening port.

2. A cleaning apparatus according to claim 1, wherein the dust evacuating system includes a guiding member internally positioned within said cover member, said guiding member having a first end disposed in proximity to the yarn fabricating head and a second end affixed to said opening port, said opening port being coupled to a means for discharging dust from said cleaning apparatus.

3. A cleaning apparatus according to claim 2, wherein said guiding member is further provided with a longitudinal slot located on a bottom thereof, said slot being dimensioned so as to prevent contact of said guiding member with the cutting element of the yarn head.

4. A cleaning apparatus according to claim 3, wherein said guiding member is a 90° elbow, said elbow having a diameter of a size substantially equal to an inner diameter of said opening port.

5. A cleaning apparatus according to claim 4, wherein said guiding member is formed of plastic material.

6. A cleaning apparatus according to claim 5, wherein said plastic material is substantially transparent.

7. A cleaning apparatus according to claim 2, wherein said means for discharging dust is a flexible conduit connected to an exhaust system, said conduit having a diameter of a size substantially equal to an outer diameter of said opening port.

8. A cleaning apparatus according to claim 1, wherein the base member includes at least one air-inlet for introducing air into the cleaning apparatus to maintain air pressure at a level sufficient for effecting complete removal of the dust through the evacuating system.

9. A cleaning apparatus according to claim 1, wherein the cover member includes a plurality of purge ports adapted for periodical manual introduction of compressed air into the cleaning apparatus.

10. A cleaning apparatus according to claim 9, wherein said cover member is formed of a plastic material.

11. A cleaning apparatus according to claim 10, wherein said plastic material is substantially transparent.

12. A cleaning apparatus according to claim 1, wherein said body member has a main portion and a top portion, said top portion protruding from the main portion in a plane perpendicular with thereof, and said base member has a fastening means engaged with said top portion thereby said body member is fixedly aligned with the base member.

13. A cleaning apparatus according to claim 12, wherein said base member is formed from a galvanized steel.

14. A cleaning apparatus according to claim 13, wherein said steel has a thickness of 16 ga.

15. A cleaning apparatus for a chenille-production machine that includes a yarn fabricating head, said head having a gauge with cutting elements and positioned on a supporting frame, the cleaning apparatus comprising:

an enclosure enshrouding the yarn fabricating head, said enclosure including:

a base member positioned in parallel and in close proximity with a back side of the yarn fabricating head and fixedly mounted to the supporting frame;

a body member circumferentially encompassing the yarn head and fixed to the base member;

a cover member secured to the body member, said body member and said cover member being shaped to complement each other, said cover member having at least one opening port for direct removal of said dust; and an automatic purge system, said system being activated in a predetermined time intervals and for a predetermined duration for continuous removal of dust produced during the manufacturing process in the working area.

16. A cleaning apparatus according to claim 15, wherein said automatic purge system includes a purge port situated on a front of said cover member and below said opening port, said purge port being coupled to an air tubing for introduction of a compressed air into a cleaning apparatus.

* * * * *